United States Patent [19]

Newell

[11] Patent Number: 4,923,738

[45] Date of Patent: May 8, 1990

[54] INTERSTITIALLY CAPACITIVE ABSORPTIVE ARTICLES

[76] Inventor: Robert D. Newell, 429 N. Main St., Roxboro, N.C. 27573

[21] Appl. No.: 189,484

[22] Filed: May 2, 1988

Related U.S. Application Data

[63] Continuation of Ser. No. 181,158, Apr. 13, 1988, abandoned.

[51] Int. Cl.[5] ..... D03D 3/00

[52] U.S. Cl. ..... 428/221; 15/229.1; 428/224; 428/253; 428/913

[58] Field of Search ..... 428/224, 913, 253, 221; 15/229.1, 229.2

[56] References Cited

U.S. PATENT DOCUMENTS 4,448,832 5/1984 Kidwell ..... 428/105

4,717,616 1/1988 Harmon et al. ..... 428/294

*Primary Examiner*—James J. Bell

*Attorney, Agent, or Firm*—Steven J. Hultquist

[57] ABSTRACT

A system comprising means for retaining fluids, such as liquids e.g., by mopping or sopping action, through the use of three-dimensional fabrics or other material articles which are structured to create optimally sized and proportioned interstices providing maximum holding capacitance ability for picking up, retaining, and releasing such fluids.

12 Claims, 3 Drawing Sheets

INTERSTITIALLY CAPACITIVE ABSORPTIVE ARTICLES

CROSS-REFERENCE TO RELATED APPLICATION

This is a continuation of U.S. Application No. 07/181,158 filed Apr. 13, 1988.

FIELD OF THE INVENTION

This invention relates generally to system comprising means for the retention of liquids or fluids and means of manufacture of fluid retention devices through the use of two-dimensional fabrics which, as a result of various treatments, are structured to create three-dimensional fabrics consisting of optimally sized and proportioned interstices providing maximum holding ability (capacitance) for retaining and releasing various fluids and/or mixtures of fluids and particulates.

DESCRIPTION OF THE RELATED ART

The raw materials in mop yarn can be of many different origins. Primarily there are two different types of fiber, cellulose-based and petroleum-based fiber. Cellulose-based fibers used in this industry are typically cotton or rayon. The most common petroleum-based fibers are polypropylene, polyester, and nylon. Cellulose fibers are those derived from natural resources without chemical restructuring of their properties, as is typical of most synthetics.

Mop yarns thus may comprise miscellaneous fibers of undetermined origin, in addition to cotton to rayon. The raw materials made of miscellaneous fibers of undetermined origin may be a blend of fibers which constitute the byproduct of the manufacturing process in textile mills running virgin raw materials. This means that as mills produce end products such as denim, sheeting, towels, etc., they throw off fibers which are assimilated through various collection devices to be baled and reused or sold. This waste fiber product consists of approximately the same fiber content, percent of natural vs percent of synthetic fibers, as that of the original end product.

A prevalent raw material used for the manufacture of mop yarn is 100% cotton fiber. This fiber is generally used in three different types: (1) virgin cotton; (2) gin motes or gin mote blend; and (3) waste of 100% cotton.

Virgin cotton is that which is used after the ginning process with no reprocessing involved. For mop yarn this generally consists of lower grade cotton such as good ordinary or below grade classes. This cotton consists of the shorter less mature, or naturally stained fibers which may contain a greater amount of leaf, stick or stem than higher grade cotton. Gin motes are one of the byproducts generated by the cotton ginning process. These by-products are the fibers separated from the virgin cotton when it is cleaned in the cotton gin. The quality of the gin mote fiber is generally directed to the quality of the virgin cotton being ginned If the cotton being ginned is of higher classes, then the gin mote will consist of better quality fiber However, if gin motes are not reprocessed prior to the manufacture of yarn they will produce a yarn with an extremely high trash content, e.g., leaf, stick and stem particles included in the fiber. Because of this most mop yarn manufactures reprocess these raw gin motes into cleaned-up blends. Waste of 100% cotton is used very little in the manufacture of mop yarn because of limited supply.

Another prevalent raw material in the manufacture of mop yarns is the cellulose based fiber, rayon. Rayon is a viscose fiber produced primarily from wood pulp or other sources of regenerated cellulose. This fiber is produced by dissolving purified cellulose using certain solvents and chemical baths for harding. After harding it is cut to staple lengths. The diameter of the fiber can vary and it is denoted by its direct relation to weight.

Most yarns are not constructed entirely of synthetic (e.g., petroleum-based) fibers. The reason for this is that many man-made fibers cannot absorb water but rather must rely on their capillary reaction to liquids. This means that the yarn must be sufficiently porous to permit the moisture to diffuse between the fibers and be held between the fibers in a clinging manner. The positive aspects of these fibers are their strength, high wearability, and limited shrinkage.

The general characteristics desirable for mop yarns and fiber structures in fluid sorption applications include:

(1) high durability and abrasion resistance;
(2) high absorption characteristics as demonstrated by soft e.g., loosely twisted yarns;
(3) ready driability;
(4) high wet tensile strength; and
(5) the ability to withstand repeated launderings and not shrink significantly.

U.S. Pat. No. 4,717,616 issued Jan. 5, 1988 to A. D. Harmon, et al discloses mop head fabric construction comprising a plurality of substantially parallel, abutting strands of textile material, such as roving, or cords of twisted strands or yarns. The main deficiency of this product lies in the fact that absorption is being accomplished through the use of the capillary action exhibited by very finely divided fibrous structures possessing a low fluid pick-up and retention capacity on a unit volume basis, thereby physically limiting the amount of fluids e.g., liquids, or mixtures of liquids and particulates, that can be absorbed per unit volume, and because of their large surface area per unit volume, the wringability and driability of this type fabric is poor. Further, fluid which is picked up by such structures is not readily released, so that such sorptive capacity as does exist is not efficiently used thereafter until the fibrous structure dries by evaporation of the retained fluid. Accordingly, it would be a significant advance in the art of fluid sorptive structure to provide structures satisfying the afore mentioned general criteria for high sorption efficiency, and which is readily made, simple in construction, struction, and cf low cost.

It is therefore an object of the present invention to provide such an improved porous structure having utility for diverse fluid sorption applications, e.g., in mop heads, synthetic sponge like pads, structural member application and the like.

SUMMARY OF THE INVENTION

The present invention is based on the suprising and unexpected discovery that instead of relying on the use of finely divided or hollow fibers or randomly created, structurally unstabilized or otherwise haphazardly created spaces, as do conventional absorptive materials, interstitially capacitive regions may be employed to contain liquids and/or fluids or mixtures of fluids and particulates within a three dimensional framework, e.g., fabric structure, which for example, need not comprise anything other that a series of open tetrahedral cells capable of retaining fluids and/or liquids by surface tension forces and capacitance between the individual legs of the polyhedral or other crystal-like structure. Fabric structures of the present invention are capable of sorbing and supporting a large amount of fluid, e.g., liquid or mixtures of liquid and particulates, utilizing very small amounts of structural material, as compared to conventional configurations of absorptive devices with structural material of inherently low pick-up and retention capacity per unit of volume, thereby physically limiting the amount of fluid held per unit volume.

The capacitive interstitial regions of the sorptive structures of the present invention possess another desirable and novel attribute in that they release fluids more easily as compared to conventional absorptive materials due mainly to the very small structural surface area required to contain a droplet of liquid or fluid in the fabric or other fluid sorptive of the invention. It is possible in the practice of the invention to utilize an involuted or twisted ribbon to create structurally stable interstitially capacitive spaces in the form of a filament, to provide large interstitial areas and relatively small structural surface areas as compared to conventional absorptive structures.

The invention also related to a method of manufacture of various types of fabric utilizing interstitially capacitive regions as a means of absorption.

DETAILED DESCRIPTION OF THE INVENTION AND PREFERRED EMBODIMENTS THEREOF

Figure 1:
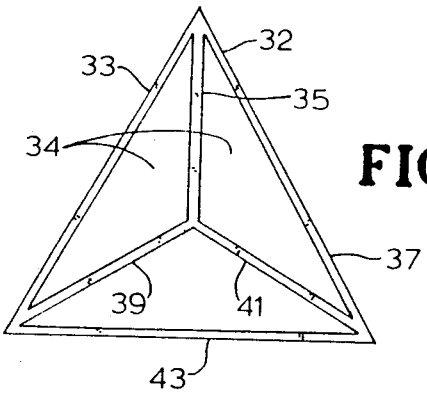
FIG. 1 is an elevational view of an interstitial region of a tetrahedral cell forming a sorptive structure according to the present invention.

With references to the drawings, FIG. 1 shows an orthoscopic view of a tetrahedral cellular structure 32 defining an interior interstitial space 34 bounded by legs 33, 35, 37, 39, 41, and 43. The legs are structural elements which may be filamentous or filar in character, as for examples being formed of materials such as rayon, blends, acrylic, polypropylene, cotton, metal, etc. The resulting tetrahedral cellular structure when placed in proximity to a fluid such as water, organic solvent, etc, provides by virtue of its shape a region into which the fluid will flow by capillarity and surface tension effects. It will be recognized that the shape of the sorptive structure may be varied widely, depending on the viscosity, surface tension, and other physical characteristics of the fluid sought to be sorbed.

Figure 2:
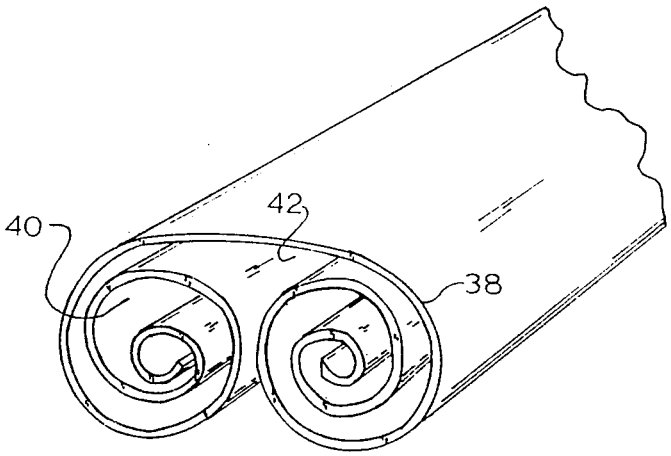
FIG. 2 is a perspective view of an absorptive filament showing its capacitance structure, according to one embodiment of the invention.

FIG. 2 shows a perspective view of a longitudinally extending filament 38. Interstitially capacitive sorptive areas are represented by numbers 40 and 42. Materials employed in the construction of this filament can be porous or nonporous materials, including, but not limited to, knitted or woven fabrics, incorporating plastics, metals, ceramics, cotton, rubber, etc. as a structural material, so that when treated as herein described, the filament will form a continuous laterally involuted structure. The resulting laterally involuted structure when placed in proximity to a fluid such as water, organic solvents, etc., provides by virtue of its shape a region into which the fluid will flow by capillarity and surface tension effects. It will be recognized that the shape of the sorptive structure may be varied widely, depending on viscosity, surface tension and other physical characteristics of the fluid sought to be sorbed.

The sorptive filament shown in FIG. 2 can be manufactured by introducing a ribbon of a knit material such as jersey onto two pairs of pull rollers with the first set revolving at a given speed and the second set revolving at some multiple thereof e.g., three times as fast, thereby stretching the material to or near but not above, its elastic limit and creating an imbalance in the internal forces present in the material, thereby causing the edges of the material to roll inward into an involute form. In an illustrative method aspect, the present invention may be carried out to make a fluid-sorptive article, By steps comprising;

(a) providing a web of a flexible material;

(b) unidirectionally stretching the flexible web to an extent in the vicinity of, but not exceeding, the elastic limit of the web; and (c) terminating the unidirectional stretching to impart involutions to the web, thereby forming an involute web as the fluid-sorptive article.

A fluid sorptive article may also be formed in accordance with the present invention by a process comprising:

(a) providing a web of flexible material; and (b) imparting collaterally imbalanced stresses to the material of the web, causing deformation of the web to yield involutions therein, resulting in an involuted web as the fluid sorptive article.

The sorptive filament shown in FIG. 2 can be manufactured in alternative manner, by introducing a web of internally and co-laterally prestressed material, into a process which selectively stress relieves only one side of the web, such as by passing the web into an appropriately designed infrared, ultrasonic, or radio-frequency heating apparatus, causing a net imbalance of stress forces to result, which in turn causes the edges of the web to roll into an involute form.

The sorptive filament shown in FIG. 2 can be manufactured in still another way, by introducing a web of internally stress-free material into a process which will induce stress on only one side of the web, as passing the web into an appropriately designed glass bead peening or shot peening apparatus can do, resulting in a net imbalance of stress forces, which causes the edges of the web to roll inwardly into an involute form.

Figure 3:
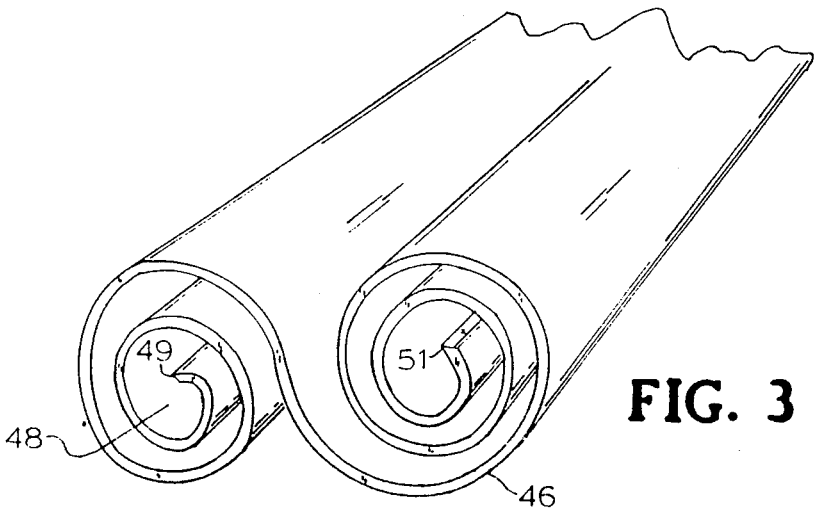
FIG. 3 is a perspective view of another embodiment of the invention.
Figure 4:
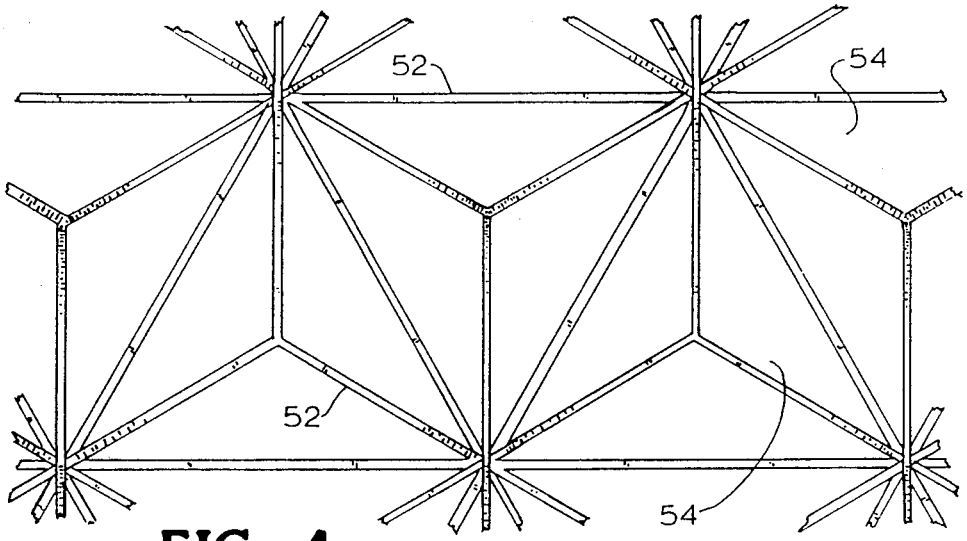
FIG. 4 is an elevational view of a lattice-like fabric, showing the three-dimensional characteristics thereof.
Figure 5:
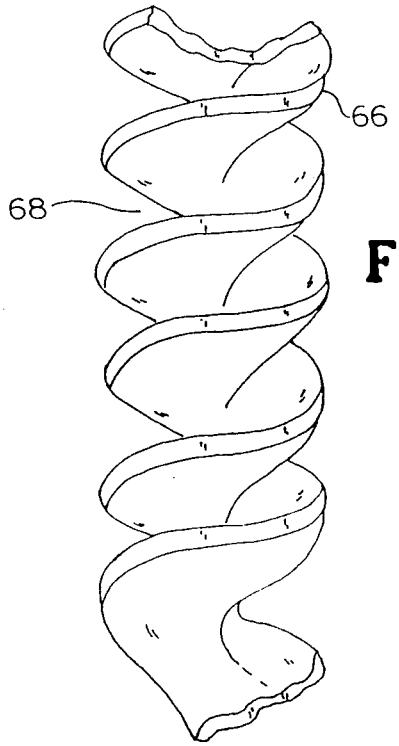
FIG. 5 is an elevational view of a helically extending ribbon comprising interstitial capacitive regions.

A similar effect may be accomplished by the structures in FIG. 2, 3, and 5 except employing composite webbed structures of laminated materials in which one side of the web is hydrophobic and the opposite side of the web is hydrophilic. If the hydrophilic side swells or bows laterally due to absorption of a liquid or due to weak magnetic interactions with a selected solvent or solute, the web will assume an involute form, and by tailoring the properties of the components of the composite webbed structures it is possible to selectively determine the degree of involutions and/or convolutions which will be responsive to various agents or reagents, liquids, fluids, heat, etc., and/or various processes and combinations thereof, creating motile structures capable of involuting and de-involuting and also by proximity capable of rolling up and trapping a predetermined liquid, and not involving and trapping another selected liquid or fluid of different composition. It should be recognized that the structural embodiments disclosed herein are applicable on a molecular level, making it possible to design molecular structures which may be motile under certain conditions, and may be used to trap some predetermined molecule or molecules by involuting in proximity to it, thereby enclosing it. A filar structure of the type shown in FIGS. 2, 3, and 5 can thus be used as a specific molecular trap by approximately tailoring the shape and size of the interstitial space therein.

This three-dimensional fabric may be constructed as a knitted fabric or may be built up from sheets of nonporous material that have been embossed and perforated or molded into a series of component shapes that form the sorptive structures when stacked on one another. The structural material employed in this material could be cellulose, plastic, wire of various metals and even ceramic or other materials.

Figure 6:
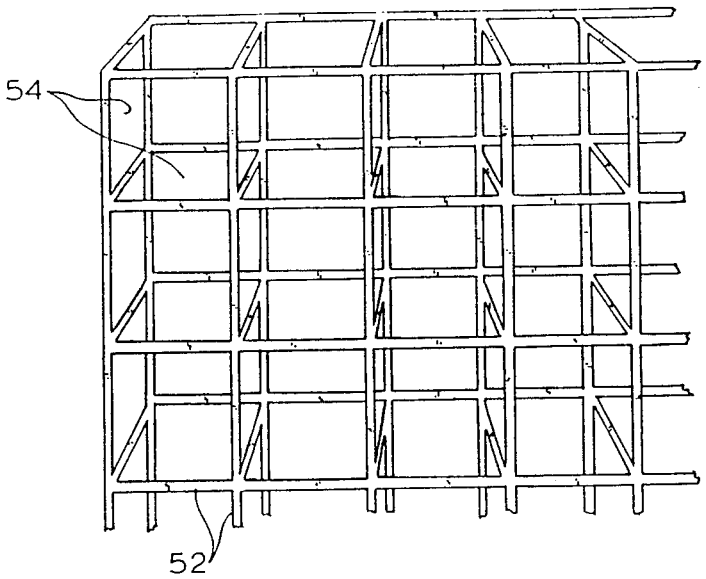
FIG. 6 is a perspective view of a capacitive absorptive filament according to still another embodiment of the invention.
Figure 7:
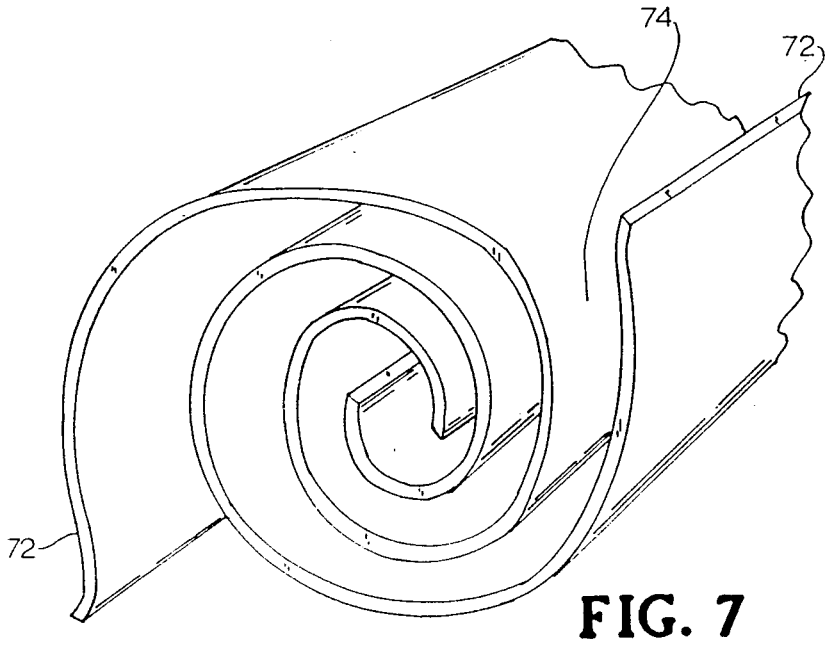
FIG. 7 is a perspective view of an involuted interposed reactive element, comprising interleaved web structures forming interstitial capacitive regions therebetween.

FIG. 5 is an elevational view of a longitudinally twisted ribbon-like filament 66 defining a fluid capacitive structure with interstitial sorptive areas 68 formed as a result of the coils of ribbon being brought into proximity with each other by virtue of its twisted structure. The resulting structure when placed in proximity to a fluid such as water, organic solvent, etc., provides by virtue of its shape a region into which the fluid will flow by capillarity and surface tension effects. FIG. 6 is a perspective view of a three-dimensional fluid capacitive structure formed by the filar elements 52 defining a plurality of interstitial spaces 54 of cube-like configuration for sorption of fluid. The filar elements may, for example, be of metal wire, or filaments of a thermoplastic material, or any other natural and/or synthetic material FIG. 7 shows a perspective view of an involuted interposed reactive element, comprising interleaved web structures 72 forming interstitial capacitive regions 74 therebetween. The resulting structure when placed in proximity to a fluid such as an electrolyte, or some chemically reactive fluid, etc., provides by virtue of its shape a region 74 into which the fluid will flow by capillarity and surface tension effects. The individual leaves may be required for the construction of a battery, for example.

What is claimed is:

1. A mop head comprising a three-dimensional open lattice filamentous polyhedral structure defining interstitial spaces therein of sufficient size and shape to take up liquid by capillarity and surface tension effects producing flow of said liquid into said interstitial spaces.

2. A mop head according to claim 2, wherein said three-dimensional structure is a tetrahedral filar structure.

3. A mop head according to claim 2, wherein said tetrahedral filar structure comprises legs formed of a material selected from the group consisting of wood, metals, plastics, ceramics, and fibrous materials.

4. A mop head according to claim 1, comprising a plurality of said three-dimensional structure.

5. A mop head according to claim 1, including a twisted fibrous web, comprising a plurality of said three-dimensional structures.

6. A mop head according to claim 5, wherein said three-dimensional structure is a tetrahedral shape.

7. A map head according to claim 5, wherein said three-dimension structures are of involute curvate shape.

8. A mop head according to claim 1, formed of a filar material.

9. A mop head according to claim 8, in the form of a web selected from the group consisting of non-woven, woven and knitted webs.

10. A mop head according to claim 1, formed from a solid web.

11. A mop head according to claim 1, wherein said three-dimensional structure comprises twisted non-woven fibrous webs.

12. A mop head according to claim 1, wherein said three-dimensional structure comprises twisted fibrous webs selected from the group consisting of non-woven, woven, and knitted webs.

* * * * *